United States Patent [19]

Grumbine

[11] Patent Number: 4,686,993

[45] Date of Patent: Aug. 18, 1987

[54] LOW PROFILE FUNCTIONAL ORTHOTIC

[75] Inventor: Michael T. Grumbine, Whittier, Calif.

[73] Assignee: Paragon Podiatry Laboratories, Whittier, Calif.

[21] Appl. No.: 759,221

[22] Filed: Jul. 26, 1985

[51] Int. Cl.[4] ..... A61F 5/14

[52] U.S. Cl. ..... 128/581; 36/43; 36/80; 128/614

[58] Field of Search ..... 128/80 R, 80 D, 581, 128/586, 590, 614, 615, 617; 36/43, , 44, 71, 80, 91, 92

[56] References Cited

U.S. PATENT DOCUMENTS

| | | | |
|---|---|---|---|
| 1,336,278 | 4/1920 | Burns | 128/616 |
| 1,408,712 | 3/1922 | Patten | 128/617 |
| 1,501,765 | 7/1924 | Freese | 128/617 |
| 1,853,296 | 4/1932 | Bonfield | 128/618 |
| 1,973,402 | 9/1934 | Bohmbach | 36/71 |
| 2,161,565 | 6/1939 | Freda | 36/71 |
| 2,252,936 | 8/1941 | Leydecker | 12/142 |
| 2,425,837 | 8/1947 | Scholl | 36/71 |
| 2,623,440 | 2/1953 | Leydecker | 36/71 |
| 2,680,919 | 6/1954 | Riggs | 36/71 |
| 2,826,834 | 3/1958 | Ratcliff | 36/71 |
| 2,828,555 | 4/1958 | Ledos | 128/617 |
| 3,861,398 | 1/1975 | Leydecker | 128/615 |
| 4,216,778 | 8/1980 | Weiss | 128/581 |
| 4,232,457 | 11/1980 | Mosher | 36/44 |
| 4,517,981 | 5/1985 | Santopietro et al. | 128/581 |

FOREIGN PATENT DOCUMENTS

| | | | |
|---|---|---|---|
| 746845 | 10/1944 | Fed. Rep. of Germany | 36/80 |
| 303241 | 11/1932 | Italy | 36/80 |

*Primary Examiner*—Edgar S. Burr
*Assistant Examiner*—Moshe L. Cohen
*Attorney, Agent, or Firm*—Fulwider, Patton, Rieber, Lee & Utecht

[57] ABSTRACT

The low profile functional orthotic constructed of polypropylene and formed with a heel, arch and forefoot area terminating short of the metatarsals. The heel portion is formed with an integral heel post and the forefoot portion is contoured on the underside to form a flat downwardly facing forefoot support surface projecting in a plane which is intersected by the upper plantar support surface at the forward extremity of the orthotic.

7 Claims, 11 Drawing Figures

FIG. 1
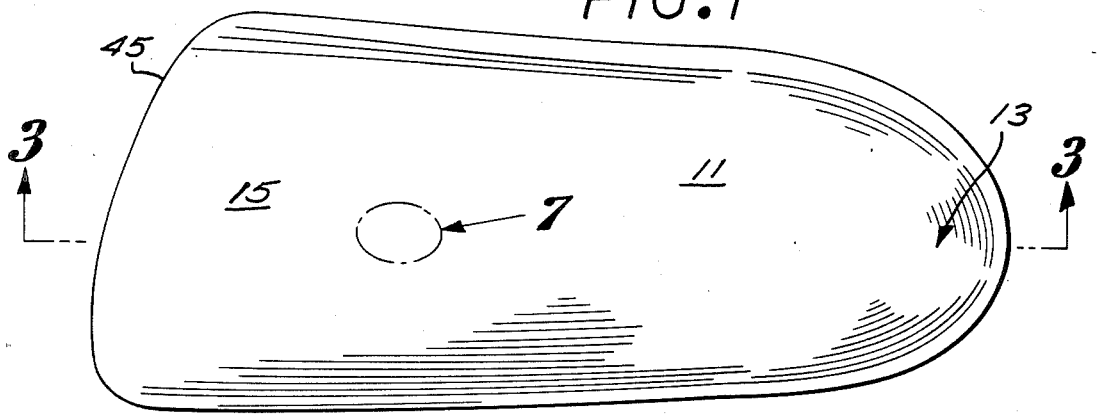
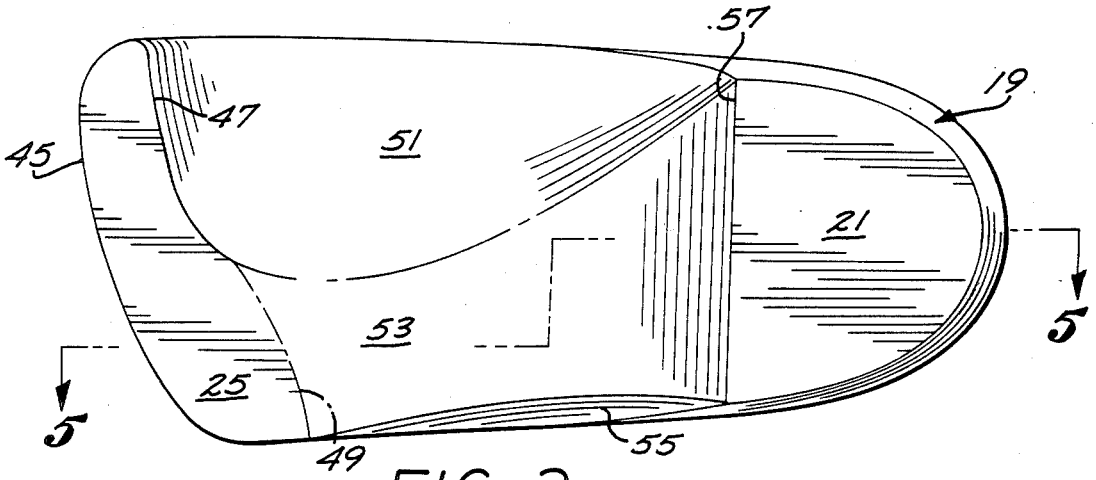
FIG. 2
FIG. 3
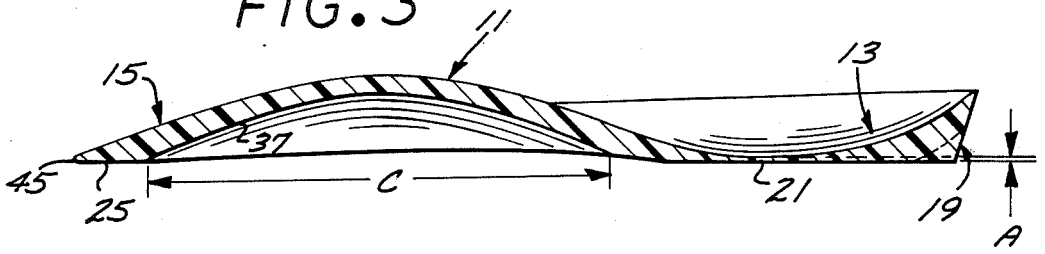
FIG. 4 PRIOR ART
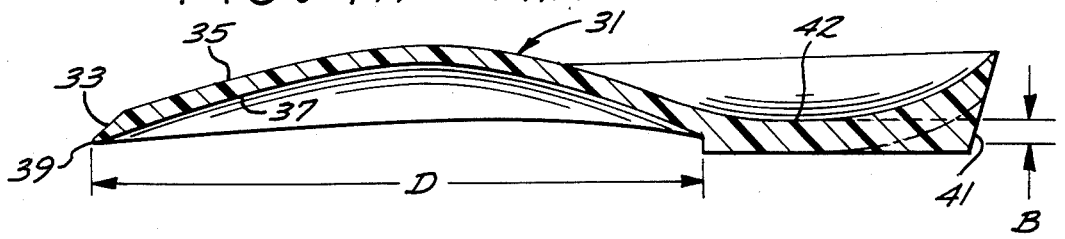

FIG. 8
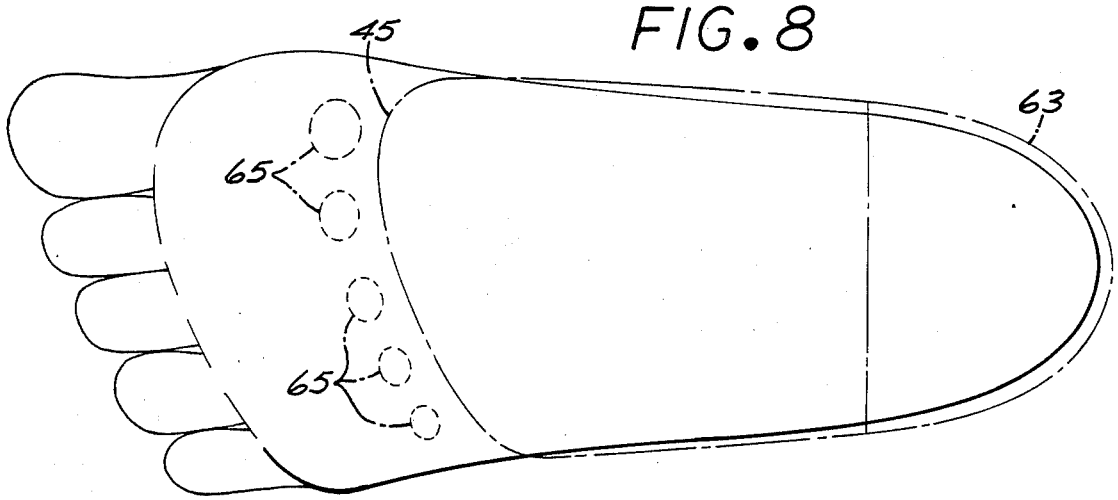
FIG. 9
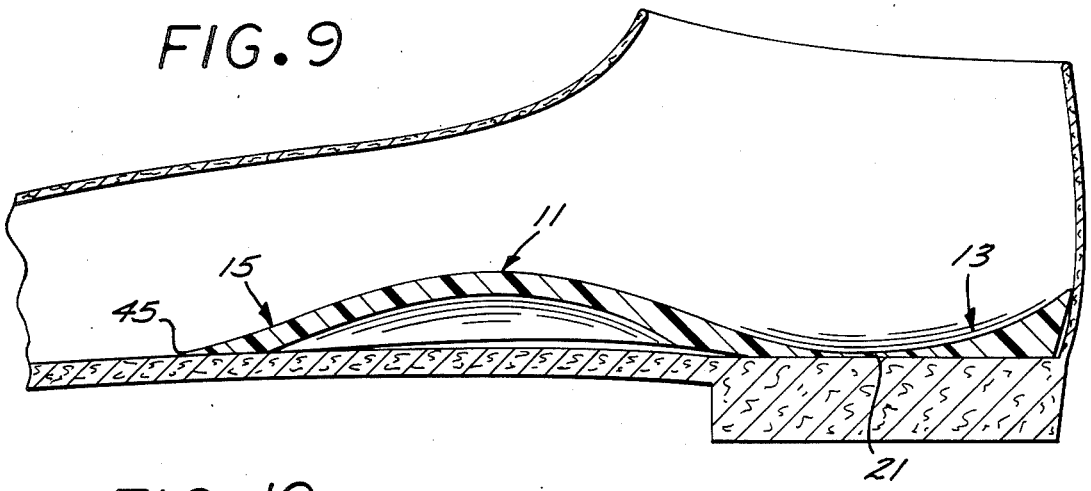
FIG. 10
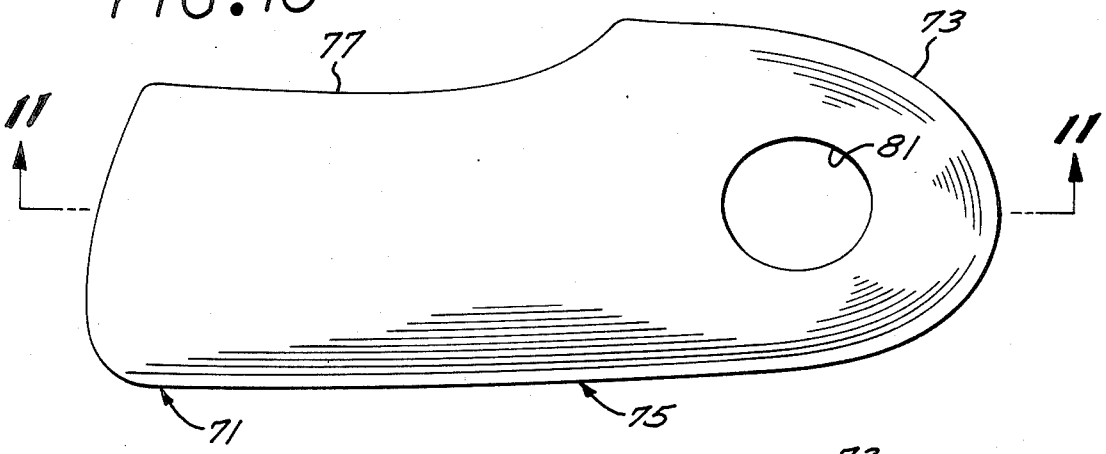
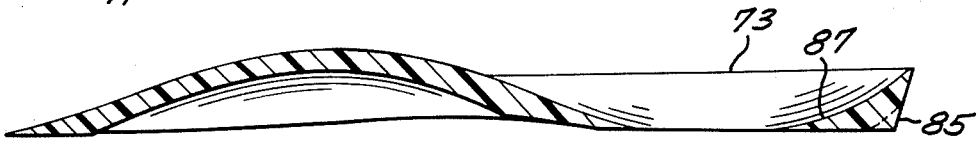
FIG. 11

LOW PROFILE FUNCTIONAL ORTHOTIC

BACKGROUND OF THE INVENTION

1. Field of the Invention:

The orthotic of the present invention relates generally to appliances for inserting in a wearer's shoe to provide foot support and, more particularly, to a functional orthotic designed to help correction foot problems.

2. Description of the Prior Art:

Orthotic devices are typically divided into two main groups. The accommodative orthotic, such as an arch support, involves older technology which is considered a non-therapeutic appliance employed to minimize the intensity of the symptoms associated with various painful foot conditions. Typically, such devices may be constructed of relatively soft materials employing a cork or sponge filler sandwiched beneath a relatively thick top layer of leather or other material.

Functional orthotics are utilized to realign the foot in the wearer's shoe to assume a "neutral" or natural position. The level of therapy of a functional orthotic is directly proportional to the amount of control afforded to the supported foot. Such control stems from the effectiveness of the orthotic in holding or supporting the foot, and all its component parts, at specific angles for different phases of gait. The object of foot control is to restrict foot deviation from the desired angles and positions and, the more effectively such movement is restricted, the greater the reduction of foot pain.

It is understood in the art that control is primarily a function of the rigidity of the orthotic shell, surface texture and rearfoot and forefoot posting, combined with the dorsal and plantar shell contours. The prime consideration of health care professionals in prescribing a functional orthotic are the level of control, and adjustability of the contour to facilitate future changes in patient therapy needs. Of equal importance are the objectives of lessening foot pain and reduction of bulk to accommodate shoe fit and durability.

Due to the inherent limitations in the properties of materials and designs heretofore used in orthotic devices and methods of fabrication, a trade-off has been necessary between the desire to reduce bulk and maintain maximum control. Typically, in order to obtain the desired control and durability, the prior art frequently utilized a three to five millimeter acrylic thermoplastic shell. An orthotic of this type has been marketed which incorporates a shell constructed of a relatively uniform thickness of about three to five millimeters. It has been determined that this rather substantial thickness throughout the length of the orthotic is necessary to afford the necessary support and required durability. However, that thickness adds substantially to the bulkiness of the orthotic and elevates the foot in the shoe to such a degree as to limit usage often to only rather bulky and oversized shoes and detracts from the wearer's comfort. Contributing to the bulk is the fact that the forefoot edge is formed on its top, or dorsal, side with a relatively abrupt chamfer surface angling upwardly and rearwardly to form an included angle of about 30 degrees with the bottom surface. The bottom, or plantar, surface of that shell angles gradually forwardly and downwardly from the arch to the plane of such chamfer surface along a laterally extending line which contacts the top of the shoe inner sole. Consequently, the forefoot portion of that acrylic orthotic is typically elevated from the top surface of the shoe insole a distance of approximately five millimeters at the point where the chamfer abruptly tapers downwardly.

Prior art orthotics have been proposed in effort to overcome the disadvantages associated with bulkiness. One short orthotic endeavored to overcome the disadvantages of thicker heavy orthotics by proposing an orthotic which extends only along one side of the orthotic and wraps around the periphery of the heel terminating on the opposite side of the foot to define a shape somewhat in the form of a "question mark". A device of this type is shown in U.S. Pat. No. 4,360,027. Such devices, while affording some therapeutic advantages, suffer the shortcoming that the foot control afforded thereby is limited due to the fact that support is afforded for only one side of the foot and none for the forward aspect of the heel. Furthermore, such device suffers the shortcoming that the bottom surface thereof at the forward extremity extends substantially parallel with the top surface thereof and is not ground away at the extreme forward extremity to form a truly horizontal surface cooperating with the top surface thereof to provide a gradual and even transition from the orthotic to the supporting shoe surface. Furthermore, this device is not considered by those skilled in the art to be a functional device, but is rather an accommodative appliance, since its design is not of the single shell controlling rigid or semi-rigid type, but rather a flexible and therefore non-controlling laminated type. In fact, its construction is identical to many prior art accommodative appliances, except that the lateral area and central heel are cut out. The area chosen to be cut out further attests to the non-functional nature of this device, since the area located 1–4 cm forward from the center of the heel is considered by those skilled in the art to be an essential element of a functional device.

Prior art orthotics typically incorporate either intrinsic or extrinsic heel posting. An orthotic with intrinsic posting is formed by a shell material which is of constant thickness equal throughout the entire length of the device. The thickness of the post is thus limited by the thickness of the plastic shells from which such orthotics are typically constructed. For a thinner shell section in the heel area requiring heel posting, when the peripheries of the heel portion are turned upwardly to accommodate the contour of the heel, there is an insufficient thickness of material to leave a flat supporting surface extending the entire lateral and longitudinal distances under the heel, thus greatly detracting from the stability and effectiveness of the heel post.

Extrinsic posting is achieved by adding material to the bottom of the orthotic shell after the molding thereof has been completed. Extrinsic posting, while affording the advantages of allowing for a wider bottom bearing surface, suffers the shortcoming that the heel post must be formed separate from the shell, bonded thereto after forming of the shell is complete. In addition to being time consuming, such a technique frequently leaves an orthotic which is subject to damage and prone to heel post separation in use. It is also often contructed from materials which adhere fairly well but wear quickly. Furthermore, since extrinsic posts are constructed by the addition of extra material, they result in an increase in bulk. Consequently, there exists a need for an orthotic which achieves the advantages of both intrinsic and extrinsic posting and obviates the shortcomings of each. This is one of the problems to which the invention of the present invention overcomes. The present invention incorporates a heel post which is heat fused to the shell prior to forming to thus be formed therewith in a wholly unitized construction. This technique is referred to as integral posting.

SUMMARY OF THE INVENTION

The orthotic invention is characterized by an orthotic shell constructed of a polyolefin plastic formed with a raised central arch having a dorsal surface which slopes rearwardly and downwardly to a heel portion and forwardly and downwardly to form a forefoot portion. An integral heel post is formed with the heel portion and is ground flat on the bottom to form a downwardly facing support surface disposed in a generally horizontal plane. Likewise, the underside of the forefoot portion is ground flat to define a downwardly facing fore post support surface also disposed in such horizontal plane.

Other objects and features of the invention will become apparent from consideration of the following description taken in connection with the accompanying drawing.

BRIEF DESCRIPTION OF THE DRAWINGS

FIG. 1 is a top plan view of a low profile orthotic incorporating the present invention;

FIG. 2 is a bottom plan view of the orthotic shown in FIG. 1;

FIG. 3 is a longitudinal sectional view taken along the line 3—3 of FIG. 1;

FIG. 4 is a longitudinal sectional view of a prior art orthotic;

FIG. 8 is a diagrammatic view, in reduced scale, showing the orthotic of FIG. 1 positioned against the bottom of a wearer's foot;

FIG. 9 is a broken longitudinal sectional view taken along the center line of a shoe in which the orthotic of FIG. 1 has been installed;

FIG. 10 is a bottom plan view of a second embodiment of the orthotic of the present invention; and FIG. 11 is a longitudinal sectional view taken along the line 11—11 of FIG. 10.

DESCRIPTION OF THE PREFERRED EMBODIMENTS

Figure 5:
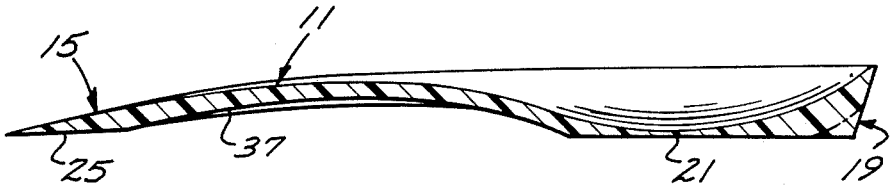
FIG. 5 is a longitudinal sectional view, taken along the line 5—5 of FIG. 2.
Figure 6:
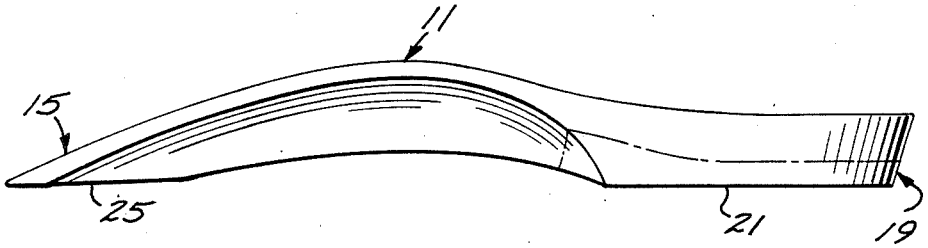
FIG. 6 is a view of the medial side of the orthotic shown in FIG. 1.

Referring to FIGS. 2 and 3, the orthotic of the present invention includes a polypropylene shell formed with a raised arch portion 11 defining on its upper surface a foot support contour which tapers rearwardly and downwardly to form a heel portion 13 and also tapers forwardly and downwardly to define a forefoot portion 15. Mounted under and integral with the heel portion 13 is a heel post, generally designed 19 which is ground off on its bottom side to form a flat downwardly facing support surface 21 disposed in a horizontal plane 23. The forward aspect of the forefoot portion 15 is also ground off to form a flat downwardly facing forefoot support surface 25 which is also disposed in the horizontal plane 23 to thereby provide a low profit orthotic which elevates the foot to only a minimum degree in the wearer's shoe.

The orthotic shell of the present invention may be constructed of any polyolefin or similar material which will afford the desired rigidity to withstand the stresses applied thereto by application of the weight of the wearer theron in use. Prior art orthotics 31 such as that shown in FIG. 4 are of acrylic or other materials which are relatively brittle and must have substantial thickness to withstand the wearer's weight. Such prior art orthotics 31 typically incorporate a shell which is of a substantially uniform thickness and which are molded to the contour of a positive mold taken from a negative mold of the wearer's foot. The prior art orthotic 31 does not incorporate any grinding on the plantar side thereof but, rather, has the upper forward edge thereof ground along a chamfer surface 33 which projects at an angle of approximately 30 degrees to the horizontal to thus afford a fall off from the contoured forefoot supporting surface 35. The dorsal and plantar surfaces 35 and 37, respectively, of the shell 31 are substantially co-extensive thus resulting in the bottom surface 37 sloping downwardly and forwardly to intersect the plane of the chamfer surface 33 along a line 39 projecting substantially laterally behind the metatarsals. Consequently, at the line 39 formed by meeting of the chamfer surface 33 and plantar surface 37, the foot is elevated from the shoe insole a distance in excess of the overall thickness of the acrylic shell.

The heel posting for the prior art shell 31 is typically an extrinsic posting wherein a heel post 41 is formed separate from the shell 31 and is bonded to the bottom of such shell after forming thereof has been completed. Consequently, the shell is left with substantially the entire thickness thereof even at the bottom of the heel cup 42 thus serving to elevate the wearer's heel by a distance corresponding with such thickness.

By contrast, the shell of the orthotic shown in FIG. 3 is turned downwardly and forwardly from the high point of the arch to form a gradual transition at the forefoot area terminating in a forward edge 45 which lies directly on the insole and projects laterally behind the metatarsals. This stems from the fact that the plantar surface has been ground off to form the horizontal forefoot post surface 25.

The forefoot post 25 for a size 8 ladies shoe will typically be constructed with a length of about $\frac{1}{8}$ inch behind the first metatarsal head with the rear edge thereof curving rearwardly along the line 47 (FIG. 2) to a length of about $\frac{3}{4}$ of an inch behind the fourth metatarsal from where it joins with the plantar surface 53 of the planar column along a line 49. As viewed in FIG. 2, the contour on the plantar surface of the shell curves upwardly and inwardly at the medial aspect of the arch to form a raised underarch area 51 and is also raised to form a thin lateral column 53 and then tapers upwardly and away along the lateral edge at 55. The lateral column tapers downwardly and rearwardly in a feathering fashion to join the front of the plantar heel post surface 21 along the line 57.

Figure 7:
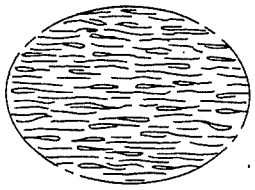
FIG. 7 is an enlarged detail view taken from the detail designed 7 in FIG. 1.

The orthotic of the present invention is fabricated by making a negative mold of the patient's foot while in the neutral position. From that negative mold, a positive mold is made of the foot for use in contouring the shell. The shell is constructed from a uniform sheet of polypropylene or similar material which is cut to a rough oversize for the size of foot and shoe for which the orthotic is intended. A heel post which may be in the form of a blank of uniform thickness approximately the size of the heel area of the insole of the shoe is then placed in overlying position on the inverted shell. The heel portion 13 of the shell and heel blank are then heated to the point where the mating surfaces tend to become molten thereby fusing the blank and shell together to create a positive union. The entire shell is at this point heated sufficiently to enable it to be molded to the general contour of the positive mold to thereby provide the desired plantary contour for foot support. Thereafter, the raised arch contour 51, lateral column surface 53 and chamfer 55 are contoured by grinding or otherwise cutting away the excess material from the plantar surface. The fore post support surface 25 and heel post support surface 21 are then formed by grinding those surfaces along separately prescribed planes to thereby generate the configuration depicted in FIG. 3. The resultant heel post is thus formed integral with the shell and that portion of the heel blank left after the grinding is primarily the peripheral portion around the deepest part of the cup depression and projecting entirely outwardly, laterally, medially, anteriorly and posteriorly to the marginal edges of the heel itself. It will be appreciated that a similar technique may be employed to form an integral forefoot post. The shell is then trimmed and finished and, a texture formed on the dorsal and plantar surfaces as shown in FIG. 7 to afford frictional resistance to shifting of the orthotic relative to the shoe and of the foot relative to the orthotic.

Since the forces on the central portion of the depression defining the heel cup 42 at the bottom thereof are compression forces, it has been found that the heel post support surface 21 may be ground off to the point where the remaining layer of material is no greater than about 1/16 of an inch in thickness. This serves to elevate the heel only about 1/16 of an inch above the inner sole as represented by the dimension A in FIG. 3 as compared to the approximately 5/32 of an inch represented by the dimension B for the prior art shown in FIG. 4, all without loss of support.

In operation, it will be appreciated that after the orthotic is fabricated it may be inserted in the wearer's shoe, generally designated 61 (FIG. 9) to span the distance from the posterior of the heel of the wearer's foot 63 (FIG. 5) to a line corresponding with the edge 45 behind the metatarsals 65. The orthotic will assume a low profile within the shoe 61 and when the wearer's foot is inserted the plantary aspect will form a smooth transition as one progresses forwardly from the forefoot support surface to the top surface of the inner sole of the shoe. It will be appreciated from FIGS. 3 and 4 that the overall distance C between the support afforded by the fore post 25 and the heel post 19 is substantially shorter than that for the distance D between the front edge 39 and the heel 41 of the prior art orthotic 31. Consequently, the stresses carried by the spanning length of the arch portion 11 are substantially less than that for the stresses carried by the longer arch of the prior art. Moreover, the longitudinal and lateral support afforded by the orthotic, particularly at the fore post 25 and the heel post 19 is complete thus avoiding any sacrifice in support due to the enhanced lower profile. The low profile becomes particularly important to the wearer, not only in comfort and affording the desired support, but in the aesthetics of the shoe design and reduction in shoe size which may be worn by the patient.

The orthotic shown in FIGS. 10 and 11 is similar to that shown in FIGS. 1–3 except that the shell is formed with a fore portion, generally designed 71, and rear portion, generally designed 73, separated by an elevated arch portion, generally designed 75, with the fore portion 71 being cut away along the lateral aspect to form a cut-out 77 and the heel being formed at the bottom of the heel cup with an opening 81. It has been discovered that in many therapeutic treatments, support from the orthotic at the lateral column is of little or no importance so that no significant support is lost by grinding the plantary surface away at the lateral edge to a point where the cut-out 77 appears. The cut-out 77 runs from a point immediately forward of the heel to curve inwardly and turn forwardly along a longitudinal line disposed medially between the fourth and fifth metatarsal.

As discussed above, the forces on the cup of the heel are primarily compressive forces. Accordingly, it has been discovered that the post plantary support surface 85 may be ground away to the point where the interior surface 87 of the heel cup intersects the plane of the support surface 85 thus generating the opening 81 which serves to further lower the profile of the orthotic while sacrificing no significant support function. It is important that the posterior, anterior, lateral and medial aspects of the heel portion 73 continue to afford support while achieving the benefits of a lowered profile.

From the foregoing it will be apparent that the orthotic of the present invention provide an economical appliance which affords all the benefits of bulky prior art appliances without exhibiting the bulkiness typically associated with such support. The unitized construction also affords a more durable appliance.

Various modifications and changes may be made with regard to the foregoing detailed description without departing from the spirit of the invention.

I claim:

1. A low profile functional orthotic for supporting a patient's foot from a bottom plane defined by the upwardly facing surface of the insole of a shoe and comprising a rigid unitary contoured supportive plastic shell formed with forefoot, arch and heel portions having respective downwardly facing forefoot, arch and heel plantar surfaces and formed on the top side with respective upwardly facing forefoot, arch and heel support surfaces cooperating together to form a contoured foot support surface, such arch portion being raised above said bottom plane to form such arch support surface elevated above said bottom plane, said forefoot support surface tapering continuously downwardly and forwardly from said arch support surface to intersect such bottom plane, such heel support surface tapering rearwardly and downwardly from such arch support surface and being dished out centrally to form raised lateral and medial walls cooperating to define therebetween a heel cup having a bottom wall formed with a thickness at its lower point of no more than 1/16th of an inch whereby such shell may be formed of plastic to form such foot support surface to afford the desired support for such foot and such forefoot and heel portions may then be ground off on their bottom sides to form said forefoot and heel plantar surfaces for disposition in said bottom plane to thus afford positive foot support while presenting a low profile within such shoe.

2. A functional orthotic for supporting a human foot according to claim 1 wherein:

said shell is constructed of polypropylene.

3. A functional orthotic for supporting a human foot in a shoe according to claim 1 that includes:

a heel post integrally mounted under said heel portion and formed with a flat plantary heel support surface extending from the heel center toward the medial and lateral sides of said shell.

4. A functional orthotic for supporting a human foot in a shoe according to claim 1 wherein:

said shell is formed with said forefoot portion extending from the medial side of said foot to a plane inside the fourth or fifth metatarsals.

5. A functional orthotic for supporting a human foot in a shoe according to claim 1 wherein:

said supportive shell is constructed of polyolefin.

6. A functional orthotic for supporting a human foot in a shoe according to claim 1 wherein:

said heel portion is sufficiently thin to cause said heel contour to intersect said bottom plane to form an opening in said heel portion.

7. A functional orthotic for supporting a human foot in a shoe according to claim 1 wherein:

such forefoot plantar surface is a ground surface.

* * * * *